US005421179A

United States Patent [19]

Bergström

[11] Patent Number: 5,421,179

[45] Date of Patent: Jun. 6, 1995

[54] CYLINDER LOCK PROVIDED WITH AN EXCHANGEABLE LOCK-CYLINDER

[75] Inventor: Boris F. Bergström, Eskilstuna, Sweden

[73] Assignee: Assa AB, Eskilstuna, Sweden

[21] Appl. No.: 21,592

[22] Filed: Feb. 24, 1993

[30] Foreign Application Priority Data

Jan. 28, 1993 [SE] Sweden ..... 9300264

[51] Int. Cl.[6] ..... F05B 27/06

[52] U.S. Cl. ..... 70/369; 70/495

[58] Field of Search ..... 70/369, 370, 371, 419, 70/420, 421, 367, 368, 494, 495, 496

[56] References Cited

U.S. PATENT DOCUMENTS

| | | | |
|---|---|---|---|
| Re. 31,910 | 6/1985 | Oliver . | |
| 1,747,383 | 2/1930 | Norviel | 70/DIG. 32 |
| 1,866,342 | 7/1932 | Best | 70/375 |
| 2,145,085 | 1/1939 | Heyer | 70/421 |
| 2,379,862 | 7/1945 | Bush . | |
| 3,206,958 | 9/1965 | Best . | |
| 3,713,311 | 1/1973 | Oliver et al. . | |
| 4,282,731 | 8/1981 | Taksony | 70/419 |
| 4,393,673 | 7/1983 | Widen . | |
| 4,424,693 | 1/1984 | Best et al. | 70/369 |
| 4,655,063 | 4/1987 | Foshee et al. | 70/419 |
| 4,756,177 | 7/1988 | Widen | 70/421 |
| 4,953,373 | 9/1990 | Toledano | 70/369 |

FOREIGN PATENT DOCUMENTS 3829790 3/1990 Germany .

*Primary Examiner*—Peter M. Cuomo
*Assistant Examiner*—Darnell M. Boucher
*Attorney, Agent, or Firm*—Sughrue, Mion, Zinn, Macpeak & Seas

[57] ABSTRACT

A cylinder lock can be manipulated by a control key (7) and a system key (8), each of which has a system code (7*a*, 8*a*) and a side code (7*b*, 8*b*). With the aid of the control key (7), the lock-cylinder (2) of the lock can be removed from the casing (3) for replacement with another cylinder. The cylinder plug (6) is surrounded by a lock-part (5) having a latching element (5a) which is moveable through an angle of about 20° between a latching and a releasing position. When replacing the lock-cylinder, the cylinder is released through the action of the side code (7*b*) on the control key (7) and a side-bar (20) which is manipulated by side pins (19) mounted in the plug (6). To this end, grooves (26, 25) provided respectively in the lock-cylinder (2) and the lock-part (5) for accommodation of the side-bar (20) may be provided with peripheral extensions which enable the side-bar to move idly.

6 Claims, 5 Drawing Sheets

CYLINDER LOCK PROVIDED WITH AN EXCHANGEABLE LOCK-CYLINDER

FIELD OF INVENTION

The present invention relates to a cylinder lock and more particularly, but not exclusively, to a high security lock of the kind defined in the preamble of claims.

High security locks of this kind are known to the art, for instance from U.S. Pat. No. 4,393,673 (Widen) and retailed under the trademark ASSA TWIN.

This high security lock includes at least two mutually independent lock systems and is manipulated by different codes on one and the same key. The blade of the key to the system lock thus has a first, conventional code which coacts with the top and bottom pin tumblers in the lock core or plug and the lock-cylinder. The other lock system includes a side-bar which is mounted in the radially outer part of the plug and which coacts with a row of side tumblers positioned laterally in the cylinder plug. These side tumblers are manipulated by a code provided on one side-part of the key, which when the key is inserted into the lock engages a bottom region of the side tumblers.

When the correct key is inserted, the first-mentioned tumblers form a dividing plane between the core and the cylinder housing and the side tumblers are moved to positions in which a radially and inwardly directed control part on the side-bar is enabled to engage waisted portions on the tumblers, such that the side-bar will move into the plug against the action of a spring force as the plug is rotated by means of the key.

The core-accommodating cylinder of a system lock of this kind may have different configurations, in accordance with the intended use of the cylinder lock. For instance, the lock-cylinder may be round and threaded at one end, so as to enable the cylinder to be screwed firmly onto a lock housing with which the cylinder lock is to coact.

The cylinder may also be accommodated in a surrounding casing which may be provided with threads for coaction with corresponding threads when mounting the lock in position.

In this case, the cylinder may have a FIG. 8 configuration for instance and be fitted into a correspondingly shaped recess or aperture in the outer casing.

One requirement of system locks of this kind is that they shall be capable of being replaced, as a guard against unauthorized opening of the lock by persons who have obtained access to a key to the lock.

The cylinder lock as a whole, i.e. including casing and lock-cylinder, can be replaced in the case of some known lock systems. This solution, however, is often unduly expensive.

In the case of other lock systems, only the plug can be replaced. The drawback with this solution, however, is that the lock can often be easily forced.

In the case of a third alternative, the lock casing is eft in place when replacing the cylinder and the plug. The lock-cylinder of this type of cylinder lock includes a lock element which can be manipulated by a separate control key which functions to move the lock element from a latching position to a release position in which the cylinder can be removed from the casing and replaced with a new cylinder.

It is the object of the present invention to provide a cylinder lock of this last-mentioned type, i.e. to provide a system lock having a replaceable lock cylinder.

DESCRIPTION OF EARLIER KNOWN PRIOR ART

Examples of known system locks having replaceable lock-cylinders can be found, for instance, in prior publications U.S. Pat. Nos. 2,379,862 (Johnstone), 3,206,958 (Best), 3,713,311 (Oliver, et al) and U.S.A. RE 31,910 (Oliver).

A number of these known locks are manipulated with the aid of a particularly configured control key, although the majority of said locks comprise conventional top and bottom pin tumblers and can therefore be forced relatively easily.

In the lock system described in the last-mentioned U.S. patent specification to Oliver, et al, there is used a side-bar with which both a system key and a control key is used to manipulate a row of pin tumblers which can be rotated so that upon insertion of the correct control key, the tumblers will move to a position in which pins or lugs projecting outwardly from the side-bar are able to enter grooves provided in the tumblers, these grooves being positioned such as to enable said pins to enter the grooves so that, when rotated, the side-bar is able to enter the cylinder plug.

At the same time, a dividing plane or shear plane is formed between the lock cylinder and the lock-part. The lock part is provided with a latching element and surrounds the plug and, when twisted, is moved into the lock-cylinder by the action of two pins which enter corresponding pin channels in the lock-part.

The side-bar and associated code on the control key form active components of this known lock system and function to move the latching element of said lock-part to its lock release position. The roll played by the latching element of such locks will be known to anyone wishing to force the lock and this person will therefore also know which pins are to be forced in order to move the latching element of said lock-part to its lock release position and therewith enable the lock-cylinder to be removed from its casing. Despite a cylinder lock of the aforesaid kind being provided with a side-bar and also with a "conventional lock system", the lock can be forced relatively easily, since the person wishing to force such a lock is able to concentrate on manipulating those pins which will enable the cylinder to be removed from its casing. This task is facilitated by the fact that the cylinder lock has only one row of pins, which in addition to their standard locking function in a system lock are also intended to coact with a side-bar.

As will be evident from the aforegoing, the present invention is intended to provide another type of lock which includes a side-bar which coacts with a further row of pin tumblers, namely side-tumblers, which in turn coact with a special code on one side-part of the key. As far as is known, it has not earlier been proposed to construct a system lock of this kind in which the lock-cylinder is replaceably accommodated in a surrounding casing.

OBJECT OF THE INVENTION

In accordance with the aforegoing, an object of the present invention is to provide a system lock of the kind defined in the preamble of claims in which the lock is replaceably mounted in its surrounding casing and with which forcing of the lock is made difficult.

SUMMARY OF THE INVENTION

These and other objects are achieved with a cylinder lock of the kind defined in the preamble of claims.

Thus, in accordance with the invention, the lock-cylinder accommodates a plug-surrounding lock-part having an outwardly projecting latching element. The lock-part can be rotated between a cylinder-latching position in which the latching element is received in an additional recess in the casing cavity, and a release position in which the latching element is swung inwardly within the cylinder contour, so as to enable the cylinder to be removed from the casing.

The rotatable lock-part is, in turn, provided with a number of pin channels, preferably three such channels, which in the latching position of the lock-part are in register with some of the pin channels provided in the plug and the lock-cylinder respectively. When the correct control key is inserted into the key slot in the plug, a dividing plane is formed between the lock-part and the lock-cylinder. Similar to the lock-cylinder, the lock-part also includes an outwardly narrowing groove which accommodates an outer edge part of the side-bar. When the correct system key is inserted into the lock and turned, this groove allows the side-bar to be pressed inwards to its release position in the plug while at the same time leaving the lock-part in its latching position.

In addition, the control key will also include a selected side code such that movement of the lock-part to its release position under the action of the control key and at least one system tumbler pin will take place in any axial position of the side-pins and with the side-bar either located in or projecting out from the plug.

These latter features of the invention mean that anyone who attempts to force the lock must know beforehand how many tumblers must be forced. If this person concentrates on attempting to force the side-pins, which enable the lock-part to be swung to its release position in order to remove the cylinder from the casing, said person cannot know whether a side code on a control key is intended to coact with side-pins of the lock and, if so, with which side-pins the side code is intended to coact. The control key may either have a side code which differs from the side code of the system key or may have the same side code as said system key. This number of possibilities concerning the configuration of the side code makes it very difficult to force the lock.

This difficulty is further enhanced because, in the first-mentioned cases, the cylinder housing may include a peripheral side-bar idling groove while the lock-part is provided with a standard side-bar groove.

Alternatively, in the second case, i.e. when the control key has the same side code as the system key, the lock-part may be provided with a peripheral side-bar idling groove which has a standard length and other standard properties.

According to a third alternative, both the lock-part and the cylinder housing may include a standard side-bar groove, in which case the control key will preferably have the same side code as the system key, which is not necessary in other cases.

These possibilities of varying the side code, which, in practice, means that in some cases the side-bar is released in conjunction with movement of the lock-part to its release position, increase considerably the difficulty of forcing the lock and consequently contributes to enhancing the security of the lock, which is an important characteristic feature of an inventive high security lock.

The safety of the lock is further enhanced in a preferred embodiment in which the latching element of the lock-part has two recesses or notches which are intended to receive a spring-biased control pin mounted in the lock-cylinder, wherein said pin is received in one or the other of said recesses depending on whether the lock-part is in its latching or its release position.

This control pin cannot be reached by a person attempting to force the lock and thus, in its own way, contributes to the advantageous qualities afforded by the invention.

Although the axial length of the lock-part may vary, said lock-part will preferably have an axial length which will enable said part to accommodate at least three pin channels for a corresponding number of system pins. In practice, this means that the lock-part will have an axial length within which that part of the forward edge of the side-bar which is received in a corresponding groove in said lock-part is activated by three side-pins.

The angle through which the lock-part is rotated between its latching and its releasing position by the control key is suitably about 20°.

So that the invention will be more readily understood and further features thereof made apparent, the invention will now be described in more detail with reference to a number of exemplifying embodiments thereof and also with reference to the accompanying drawings.

DETAILED DESCRIPTION OF THE INVENTION

Figure 1:
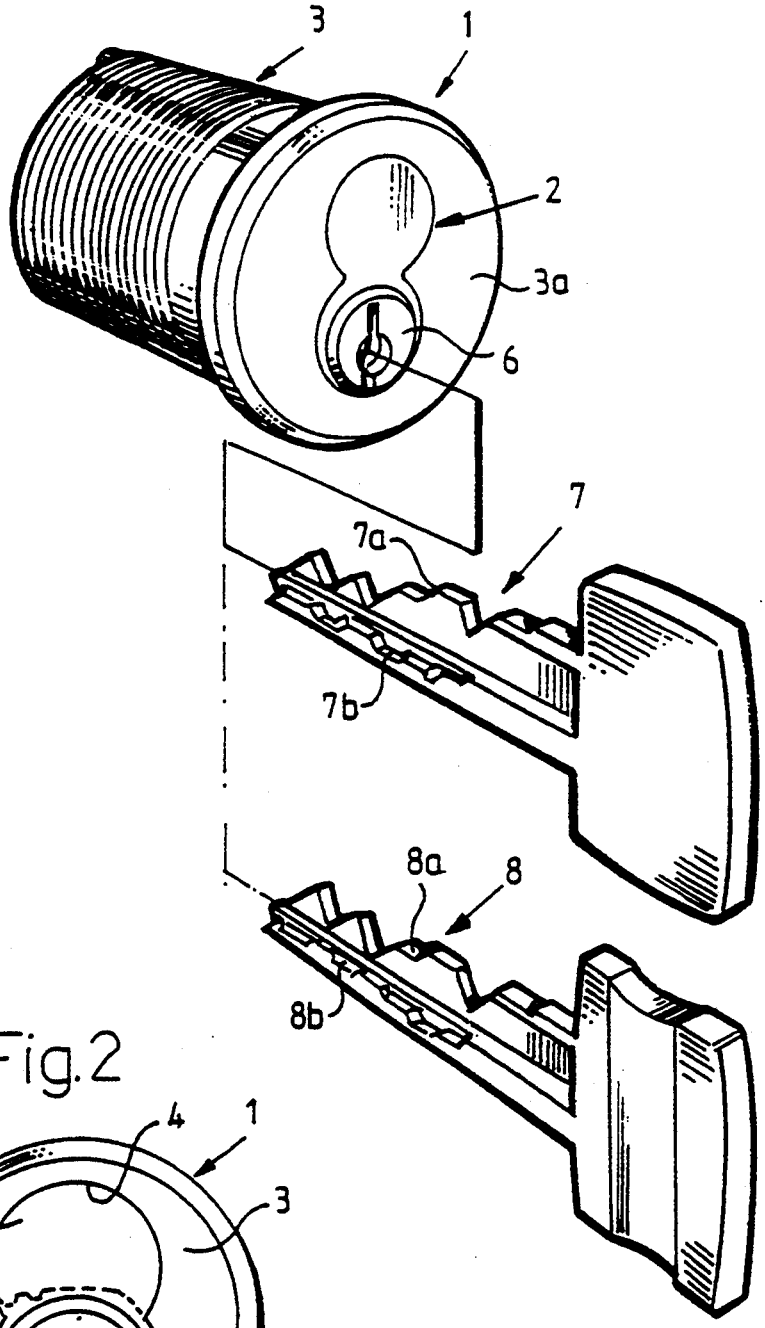
FIG. 1 is a perspective view of an inventive cylinder lock having a replaceable lock-cylinder mounted in a casing, and also shows a control key and system key belonging to the lock.
Figure 2:
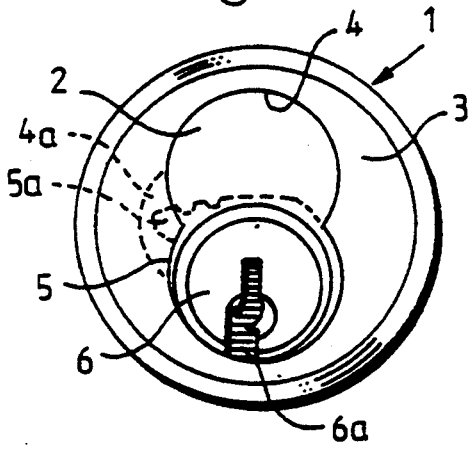
FIG. 2 is a front view of the cylinder lock shown in FIG. 1.
Figure 3:
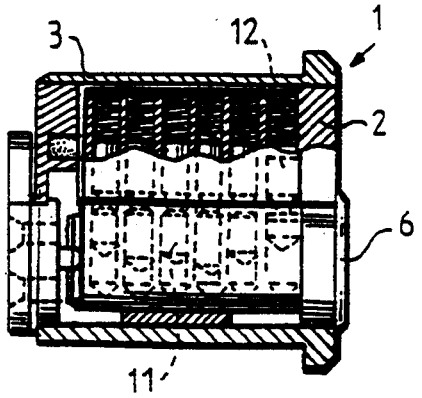
FIG. 3 is a cross-sectional view of a modified embodiment of the cylinder lock shown in FIG. 1, wherein the casing is plain, i.e. has no threads.

FIGS. 1 and 2 illustrate a cylinder lock 1 having a replaceable lock-cylinder 2 which is housed in a casing 3 provided with a front plate or escutcheon 3*a*. The lock-cylinder 2 can be moved axially in a cavity 4 in the casing 3. As will be seen in FIGS. 2 and 4, the cavity 4 has a further cavity 4*a* which receives a latching element 5*a* provided on a lock-part 5, as described in more detail hereinafter.

The lock-cylinder can be removed from the casing with the aid of a control key 7 having a code 7*a* which manipulates central pins and a side code 7*b* which manipulates side-pins.

The cylinder core or plug 6 can be rotated for "standard" lock function with the aid of a system key 8 provided with a code 8*a* which manipulates the central pins and a code 8*b* which manipulates the side-pins. The core 6 has a key slot 6*a*.

The lock-cylinder 2 accommodates a lock-part 5 having a latching element 5*a* which is shown in FIG. 2 in its latching position in broken lines. The lock-part—referenced 5 in FIGS. 3–9—can be rotated by the control key 7 so that the latching element 5*a* is brought to a release position in which the cylinder can be removed, c.f. FIG. 6.

Figure 4:
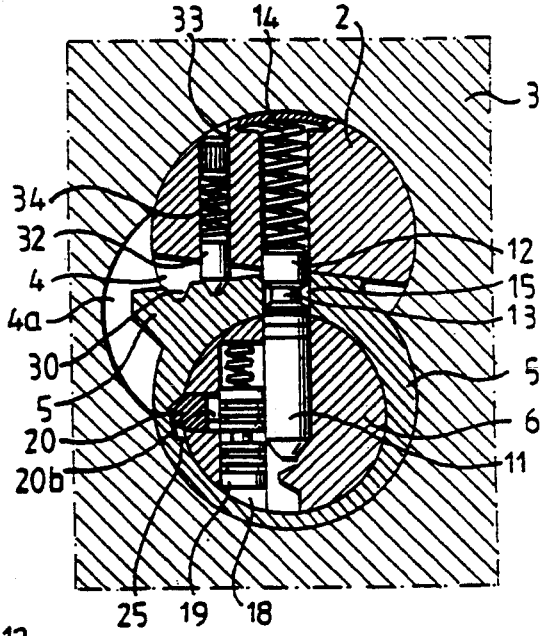
FIG. 4 is a cross-sectional view on larger scale of the lock-part of a cylinder lock according to FIG. 3 and shows the latching element of the lock-part in its latching position.
Figure 5:
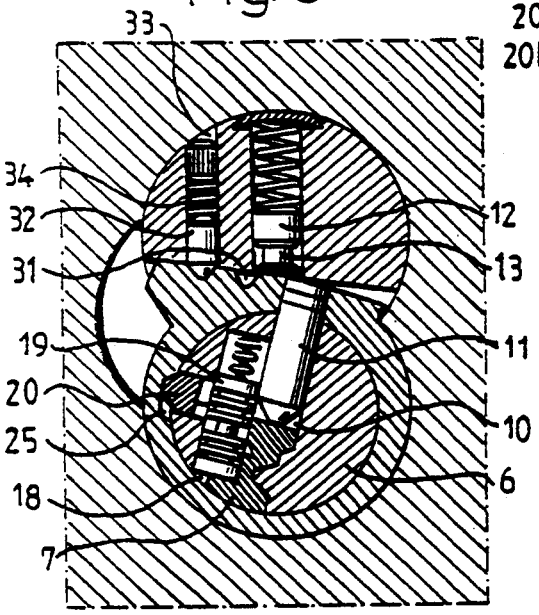
FIG. 5 is a cross-sectional view corresponding to FIG. 4 with a control key inserted into the key slot of the plug and with the plug rotated so that the latching element of the lock-part occupies its release position.
Figure 6:
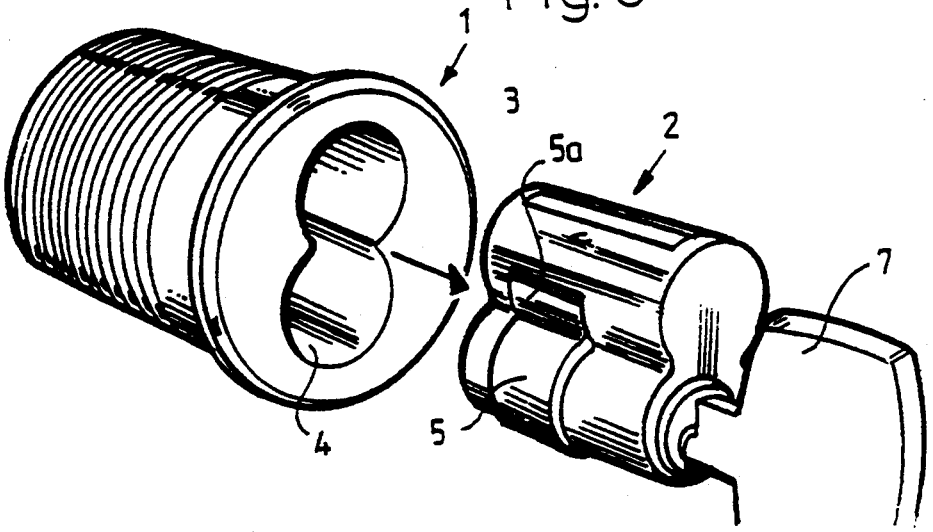
FIG. 6 is a perspective view of a cylinder lock according to FIG. 1 with the lock-cylinder removed from the casing and with a control key inserted into the cylinder plug.

The general configuration of the lock-cylinder 2, the plug 6 and the lock-part 5 can best be seen from FIGS. 3–6, of which the sectional views of FIGS. 4 and 5 also show those pins that are accommodated in the lock-cylinder 2 and the plug 6.

The plug thus includes a first row of pin channels 10 for accommodating system pin tumblers including bottom tumblers 11 which coact with intermediate pin tumblers 13 in pin channels 15 in the lock-part 5, and upper pin tumblers 12 in pin channels 14 in the lock-cylinder 2.

These pin tumblers 11, 12 and 13 are manipulated by the system code 7*a* on the control key 7 and by the code 8*a* on the system key 8.

The plug is also provided with a row of side tumblers or pins 19 which are accommodated in pin channels 18. These pins coact with a side-bar 20 having a forward, narrowing edge 20*a* which is received in a groove 25 in the lock-part 5 and which is referenced 26 in the lock-cylinder.

The side-bar 20 also includes an inner guide part 20*b* which, when the side-pins 19 are in their correct positions, engages in a waisted portion of respective pins, therewith enabling the side-bar to move to a release position against the action of a spring, when the plug 6 is rotated.

As will be seen from FIGS. 4–6, the lock-part 5 surrounds a part of the plug 6 and the outer contour of the lock-part 5 coincides with the outer contour of the lock-cylinder 2 when the latching element 5*a* is located in its release position. The lock-part 5 has an axial length which enables three pin channels 15 to pass through the periphery thereof. A corresponding part of the side-bar 20 which enters the groove 25 in the lock-part is acted upon by three side-pins 19. As illustrated in FIGS. 4 and 5, the groove 25 in the lock-part 5 has an extension which enables the side-bar 20 to perform an idling movement as the lock-part 5 is rotated by the control key 7 when wishing to remove the cylinder. Consequently, the control key can have any desired side code; in other words, it is not necessary for the side-pins to adopt a correct code position which permits radial movement of the side-bar 20 inwardly in the plug, in order to be able to remove the lock-cylinder. Instead, in the case of the FIGS. 4 and 5 embodiment, the side-bar is released in conjunction with changing a lock-cylinder.

However, the side code on the control key may quite possibly correspond to the side code on the system key, in which case the side-bar 20 is able to move inwardly in the plug 6 when changing the lock-cylinder. These alternative side-code possibilities render forcing of the lock difficult. Alternative possibilities in the configuration of the core-receiving grooves 26 and 25 provided in the lock-cylinder 2 and the lock-part 5 respectively will be described in more detail later on, with reference to FIGS. 7–9.

However, a further element which renders forcing of the lock difficult will be described first, with reference to FIGS. 4 and 5.

It will be seen from these Figures that the lock-part 5 has two recesses or apertures 30 and 31 in a region adjacent the latching element 5*a*, these recesses being intended to receive a control pin 32 which is mounted in a pin channel 33 and activated by a spring 34. The control pin 32 changes position from the recess 31 to the recess 30, as the lock-part is rotated by means of the control key from the position shown in FIG. 1 to the position shown in FIG. 5. The control pin 32 cannot be reached from the key slot 6*a* and makes any attempt to force the lock difficult to achieve.

Figure 7:
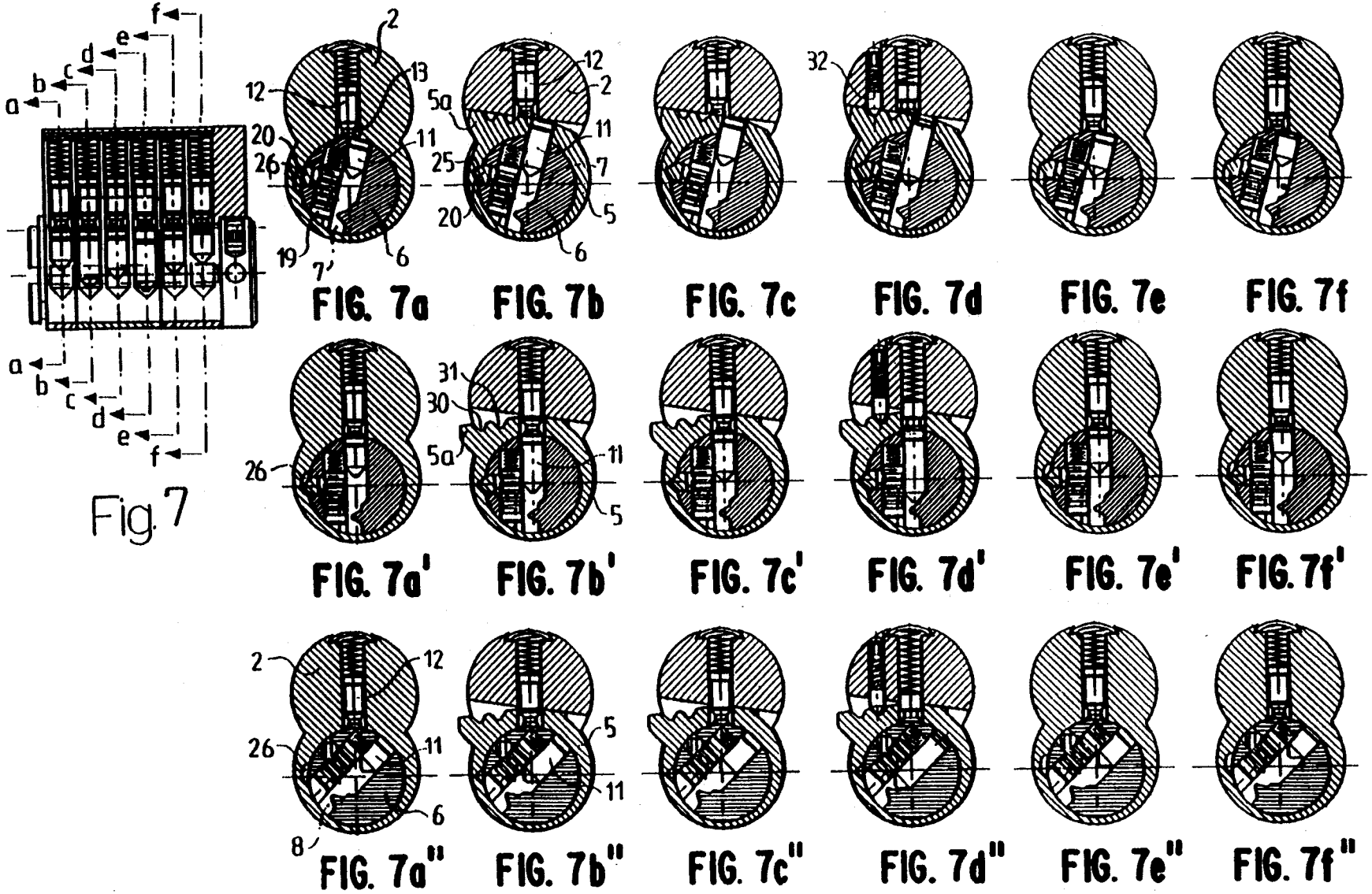
FIGS. 7, 8 and 9 are each cross-sectional views of three alternative embodiments of an inventive cylinder lock. Each Figure includes eighteen part-sectional views (i.e., FIGS. *7a–7f*, *7a'–7f'*, *7a''–7f''*; FIGS. *8a–8f*, *8a'–8f'8a''–8f''*; and FIGS. *9a–9f*, *9a'–9f'*, *9a''–9f''*); taken on lines a—a, b—b, c—c, d—d, e—e and f—f in respective Figures. The sectional views a—f are relevant views taken through the cylinder of respective embodiments subsequent to inserting a control key, which is indicated graphically by a line in the drawings, and show the plug rotated so as to bring the latching element of said lock-part to its release position. The views a'—f' show the lock-cylinder with the latching element of said lock-part in its latching position, subsequent to having removed the control key, while the views a''—f'' show the lock-cylinder with a system key inserted and the plug rotated with the aid of said key while the latching element of the lock-part is located in its locking position. For the sake of clarity, the control key has been shown solely by graphic indication in sectional-views a–f of all FIGS. 7–9. This also applies to the system key in all sectional views a''–f'' in the relevant FIGS. 7–9.
Figure 8:
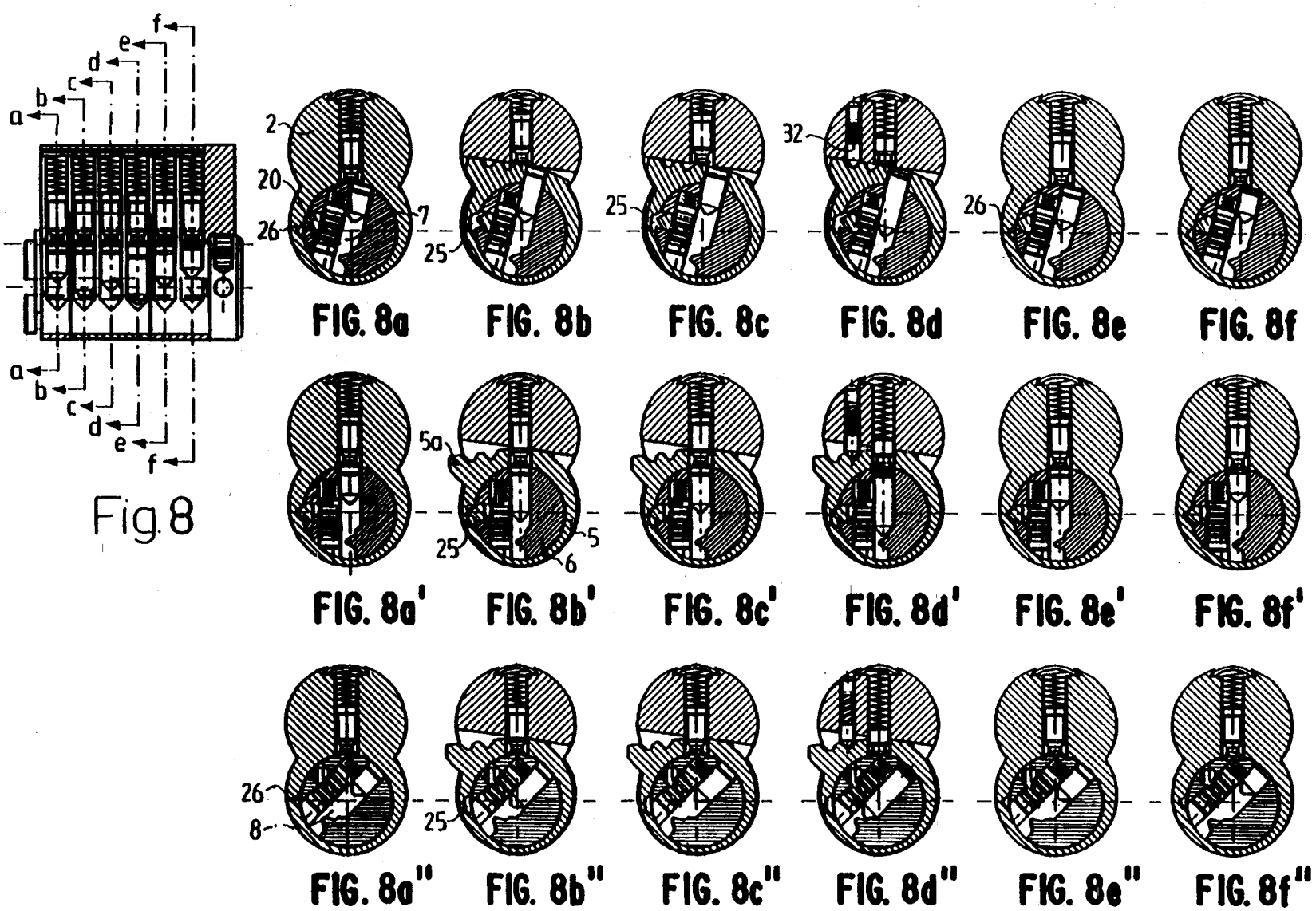
Figure 9:
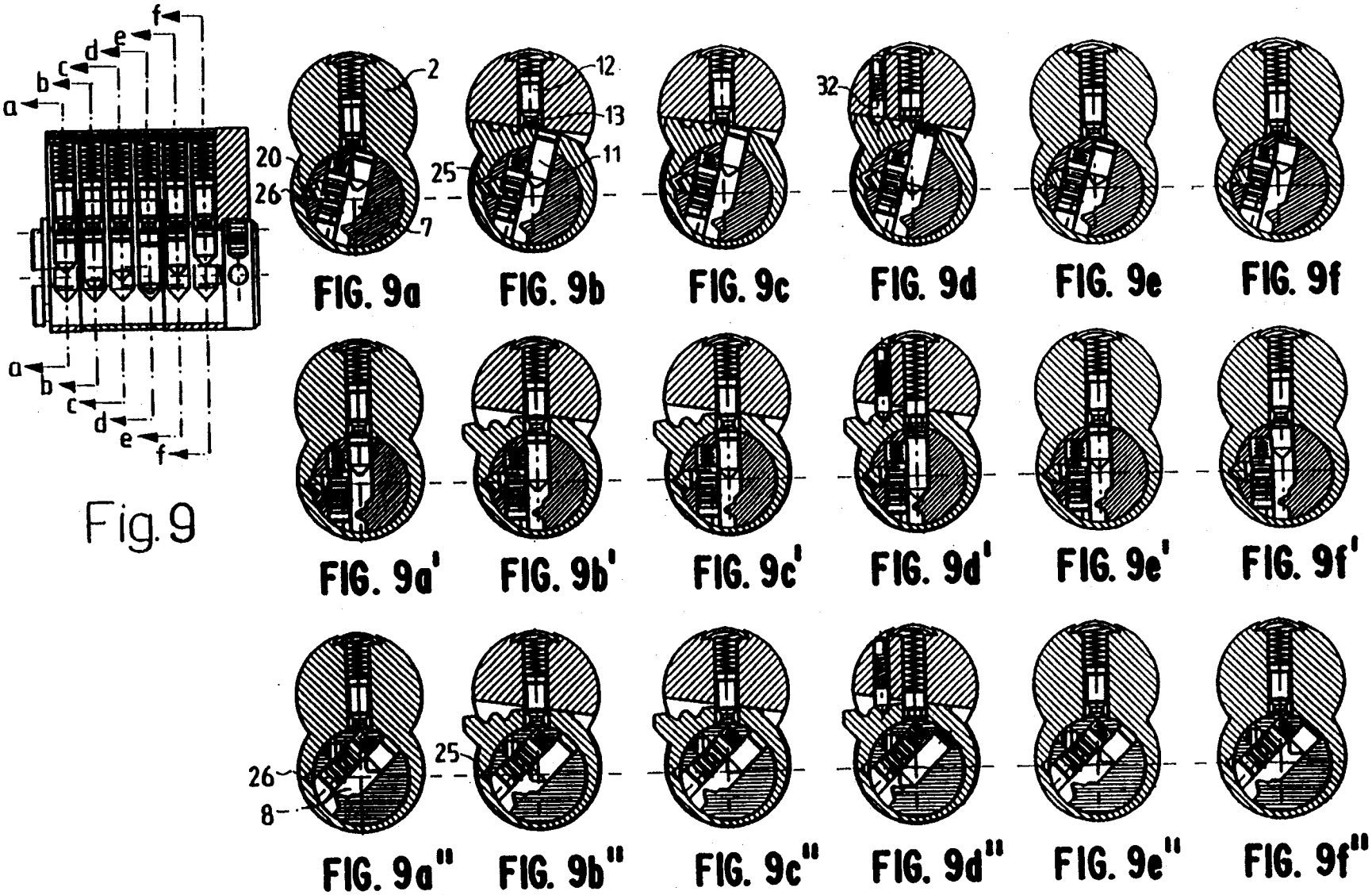

The sectional views shown in FIGS. 7–9 illustrate, as before mentioned, different alternative possibilities of configuring the groove 25 in the lock-part 5 and the groove 26 in the lock-cylinder 2 to enable the side-bar 20 coacting with the side-pins 19 to be released when removing the lock-cylinder 2 from the casing 3 with the aid of the control key 7, in order to replace said lock-cylinder with another lock-cylinder. In the following description of the various sectional views a—f, a'–f' and a''–f'' with reference to the different FIGS. 7–9, it is assumed that in the sectional views a–f of each Figure, a control key 7 has been inserted into a respective key slot, and that a system key 8 has been inserted into the key slot of each sectional view a''–f''. For the sake of illustration, however, the control keys and system keys have only been indicated graphically by a straight line in respective Figures.

The sectional views b, c, d, b', c', d' and b'', c'', d'' have been taken on a plane through the lock-part 5 surrounding the plug 6. The remaining views, referenced a, e, f, a', e', f' and a'', e'', f'' are taken on planes which extend through other parts of the lock-cylinder that lack the lock-part 5.

The sectional views a—f of each of the FIGS. 7–9 illustrate the operational state of the lock when the latching element 5*a* of the lock-part 5 has been rotated to its release position, after insertion of the control key 7.

The sectional views a'–f' in each Figure illustrate the operational state of the lock when the latching element 5a of the lock-part 5 is in its latching position and the key is removed.

Sectional views a"–f" in each of said Figures illustrate the operational state of the lock when the latching element 5a of the lock-part 5 is in its latching position and the cylinder plug 6 has been rotated through about 40° with the aid of a system key 8 inserted into the key slot 6a in the plug 6.

In the sectional views a–f of all FIGS. 7–9, a dividing plane is formed between the lock-part 5 and the lock-cylinder 2, and said sectional views show that the lock-part 5 has been turned by the control key 7 to said release position with the aid of one or more pins 11 passing through a respective pin channel or pin channels in the lock-part 5.

No dividing planes are found between the plug-lock-part or between lock-part-lock-cylinder in the operational state of the lock shown in sectional views a'–f' of all Figures.

In the operational state of the lock illustrated in sectional views a"–f" in all FIGS. 7–9, there is a dividing plane between the plug 6 and the lock-part 5 which is shown in a position with the latching element 5a in its latching position.

The various embodiments illustrated in FIGS. 7, 8 and 9 differ from one another with regard to the configuration of the side-bar receiving grooves, said side-bar being referenced 25 in the lock-part 5 and 26 in the lock-cylinder 2.

In the case of the embodiment illustrated in FIG. 7 and associated sectional views, the groove 25 in the lock-part has a "standard" configuration, i.e. the shape of the groove is adapted to the shape of the narrowing front edge 20a of the side-bar 20.

On the other hand, the side-bar accommodating groove 26 in the lock-cylinder 2 has a peripheral extension so as to enable the side-bar to rotate idly through the angle of about 20° required in conjunction with the pivotal movement of the plug as the lock-part 5 is rotated from its latching position to its release position.

FIG. 8 and associated sectional views illustrates an alternative embodiment in which the groove 26 in the lock-cylinder 2 has a "standard" configuration, i.e. it lacks a peripheral extension for accommodating idling of the side-bar 20. Instead, the groove 25 in the lock-part 5 is extended so as to enable the side-bar 20 to pass freely in the lock-part 5. However, it will also be seen from FIG. 8 that the inserted control key has a side code which allows the side-bar to move inwardly into the plug 6.

FIG. 9 and associated sectional views illustrate an embodiment in which both the side-bar accommodating groove 26 in the lock-cylinder 2 and the side-bar accommodating groove 25 in the lock-part 5 have a "standard" configuration, i.e. lack a peripheral extension. In this case, it is assumed that the side code 7b of the control key 7 corresponds to the side code 8b of the system key 8, i.e. so that when the lock-cylinder is turned by means of the control key 7, the side-bar 20 is able to move radially inwards in the plug and in this inserted position accompany the rotational movement of the plug 6 and the lock-part 5 through an angle of about 20°. The side-bar can also be said to be idle in this case, i.e. it does not take an active part in the release of the lock-cylinder 2 from the casing 3.

The fact that the different aforedescribed embodiments can be used alternately with one another means that it is impossible for anyone attempting to force the lock to have prior knowledge of the lock embodiment which is applicable from one instance to the other. This makes any attempt to force the lock extremely difficult to achieve. Forcing of the lock is made even more difficult by the aforedescribed control pin.

I claim:

1. A cylinder lock having a replaceable lock-cylinder and comprising:

a) a casing (3);

b) a casing cavity (4);

c) a lock-cylinder (2) having an outer contour and which is mounted for axial movement in the casing cavity (4);

d) a plug (6) mounted in the lock-cylinder (2) and having a key slot (6a);

e) a first row of pin channels (10) in the plug (6) for coaction with system pins which include bottom pins (11) for coaction with top pins (12) and intermediate pins (13) in pin channels (14) in the lock-cylinder (2);

f) a second row of pin channels (18) in the plug (6) for receiving side-pins (19) which are manipulated by a side code (7b, 8b) on a key (7, 8) belonging to said lock, said side-pins coacting with a side-bar (20) which in a locking position is received in an axially extending outwardly tapering groove (26) in the lock-cylinder (2) and which, when a correct system key (8) is inserted, is radially movable inwardly to a release position in the plug, therewith enabling the plug (6) to rotate in relation to the lock-cylinder (2); wherein g) the lock-cylinder (2) accommodates a lock-part (5) which surrounds the plug (6) and which has an outwardly projecting latching element (5a), said lock-part being rotatable through an angle between a lock-cylinder latching position in which the latching element (5a) is received in an additional recess (4a) in the cavity (4), and a release position in which the latching element is swung inwardly of the outer contour of the lock-cylinder, so as to enable the lock-cylinder to be removed from the casing (3);

h) the lock-part (5) includes pin channels (15) which in the latching position of the lock part are in register with some of the pin channels (13, 14) in the plug (6) and in the lock-cylinder (2) respectively;

i) when a correct control key (7) is inserted into the key slot (6a) of the plug (6), there is formed a dividing plane between said lock-part (5) and said lock-cylinder (2);

j) the lock-part (5) also includes an outwardly narrowing groove (25) which accommodates an outer edge-part (20a) of the side-bar (20), said groove (25) in the latching position of the lock-part (5) being at least partly in alignment with the groove (26) in the lock-cylinder (2);

k) one of the groove (26) in the lock-cylinder (2) and the groove (25) in the lock-part (5) has a peripheral extension, said peripheral extension being sized so as to allow relative rotation between the lock-part (5) and the lock-cylinder (2) or between the lock-part (5) and the plug (6), with the side-bar (20) performing an idling movement in the locking position thereof through an angle corresponding to the angle for rotating the lock-part (5) between the release position and the latching position or vice versa; and wherein l) the control key (7) has a side code (7*b*) such that rotation of the lock-part to said release position by the control key (7) is effected with at least one system pin (11), with the side-bar (20) either accommodated in the plug (6) or projecting out therefrom.

2. A lock according to claim 1, wherein two recesses (30, 31) are provided proximate to the latching element (5*a*) of the lock-part (5) for receiving a spring-biased control pin (32) mounted in the lock-cylinder (2), wherein said control pin enters into one or the other of said recesses (30, 31) according to whether the lock-part (5) is in its latching position or its release position.

3. A lock according to claim 1, wherein the lock-part (5) has an axial length which will enable it to accommodate pin channels (15) for at least three system pins (11–13).

4. A lock according to claim 1, wherein when manipulated by the control key (7), the angle for rotating the lock-part (5) is about 20°.

5. A lock according to claim 1, wherein the angle of the idling movement of the side-bar (20) is about 20°.

6. A cylinder lock having a replaceable lock-cylinder and comprising:

a) a casing (3);

b) a casing cavity (4);

c) a lock-cylinder (2) having an outer contour and which is mounted for axial movement in the casing cavity (4);

d) a plug (6) mounted in the lock-cylinder (2) and having a key slot (6*a*);

e) a first row of pin channels (10) in the plug (6) for coaction with system pins which include bottom pins (11) for coaction with top pins (12) and intermediate pins (13) in pin channels (14) in the lock-cylinder (2);

f) a second row of pin channels (18) in the plug (6) for receiving side-pins (19) which are manipulated by a side code (7*b*, 8*b*) on a key (7, 8) belonging to said lock, said side-pins coacting with a side-bar (20) which in a locking position is received in an axially extending outwardly tapering groove (26) in the lock-cylinder (2) and which, when a correct system key (8) is inserted, is radially movable inwardly to a release position in the plug, therewith enabling the plug (6) to rotate in relation to the lock-cylinder (2); wherein g) the lock-cylinder (2) accommodates a lock-part (5) which surrounds the plug (6) and which has an outwardly projecting latching element (5*a*), said lock-part being rotatable between a lock-cylinder latching position in which the latching element (5*a*) is received in an additional recess (4*a*) in the cavity (4), and a release position in which the latching element is swung inwardly of the outer contour of the lock-cylinder, so as to enable the lock-cylinder to be removed from the casing (3);

h) the lock-part (5) includes pin channels (15) which in the latching position of the lock part are in register with some of the pin channels (13, 14) in the plug (6) and in the lock-cylinder (2) respectively;

i) when a correct control key (7) is inserted into the key slot (6*a*) of the plug (6), there is formed a dividing plane between said lock-part (5) and said lock-cylinder (2);

j) the lock-part (5) also includes an outwardly narrowing groove (25) which accommodates an outer edge-part (20*a*) of the side-bar (20), said groove (25) in the latching position of the lock-part (5) being at least partly in alignment with the groove (26) in the lock-cylinder (2);

k) one of the groove (26) in the lock-cylinder (2) and the groove (25) in the lock-part (5) has a peripheral extension;

l) the control key (7) has a side code (7*b*) such that rotation of the lock-part to said release position by the control key (7) is effected with at least one system pin (11), with the side-bar (20) either accommodated in the plug (6) or projecting out therefrom; and wherein m) two recesses (30, 31) are provided proximate to the latching element (5*a*) of the lock-part (5) for receiving a spring-biased control pin (32) mounted in the lock-cylinder (2), wherein said control pin enters into one or the other of said recesses (30, 31) according to whether the lock-part (5) is in its latching position or its release position.

* * * * *